US006371477B1

(12) United States Patent
Lin

(10) Patent No.: US 6,371,477 B1
(45) Date of Patent: Apr. 16, 2002

(54) AUTOMATIC PAPER FEEDING MECHANISM

(75) Inventor: Shein-Chi Lin, Hsin-Chu (TW)

(73) Assignee: Avision, Inc., Hsin-Chu (TW)

( * ) Notice: Subject to any disclaimer, the term of this patent is extended or adjusted under 35 U.S.C. 154(b) by 38 days.

(21) Appl. No.: 09/612,878

(22) Filed: Jul. 10, 2000

Related U.S. Application Data

(63) Continuation-in-part of application No. 09/298,884, filed on Apr. 26, 1999.

(30) Foreign Application Priority Data

Aug. 18, 1999 (TW) ..... 88104298A01

(51) Int. Cl.[7] ..... B65H 3/52; B65H 3/34
(52) U.S. Cl. ..... 271/121; 271/167
(58) Field of Search ..... 271/121, 167

(56) References Cited

U.S. PATENT DOCUMENTS 4,865,306 A * 9/1989 Himegi ..... 271/121
5,026,042 A * 6/1991 Miller ..... 271/119 X
5,253,854 A * 10/1993 Tanoue et al. ..... 271/10 X
5,573,338 A * 11/1996 Morikawa ..... 400/611 X
5,718,425 A * 2/1998 Veigl ..... 271/121
6,102,389 A * 8/2000 Sakurai et al. ..... 271/121
6,135,443 A * 10/2000 Yano ..... 271/121

FOREIGN PATENT DOCUMENTS

EP 0 409 153 A2 * 1/1991 ..... B65H/5/06

* cited by examiner

*Primary Examiner*—Christopher P. Ellis
*Assistant Examiner*—Kenneth W. Bower
(74) *Attorney, Agent, or Firm*—H. C. Lin Patent Agent

(57) ABSTRACT

A resilient friction pad is pushed by a spring against a conveying roller for feeding paper automatically in a printer. The friction pad is placed in a recess at the end of the paper tray. A flat auxiliary spring may be used to share the pressure of a heavy paper load and to prevent the separation of the resilient friction pad and the conveying roller. A support block may be placed underneath the resilient friction pad to prevent sagging of the resilient friction pad. A corrugated arm may be inserted between the push-up spring and the resilient friction pad to provide wider contact between the resilient friction pad and the conveying roller. Two springs are located at the tail end of the resilient friction pad: one to lift to paper tray when the paper stack is light and the other to depress the paper stack so that paper in the upper section of the remaining paper stack does not push the paper being fed so hard that more than one sheet of paper are fed.

6 Claims, 20 Drawing Sheets

AUTOMATIC PAPER FEEDING MECHANISM

This patent application is a Continuation-in-part application of U.S. patent application Ser. No. 09/298,884, filed Apr. 26, 1999.

INTRODUCTION

This invention relates to a printer, scanner, copier, facsimile machine, etc., particularly the paper feeding mechanism of the printer, etc. to automatically place the paper in position for printing. Traditional paper feeding mechanism for a printer is shown in FIG. 1A. FIG. 1B shows the cross-sectional view of the feeding mechanism along the section line AA 'in FIG. 1A. The end of the paper tray 10 hangs out nearly horizontally as shown in FIG. 1B The front end of the paper tray 10 has a springboard 10A which presses against a conveying roller 14 by the spring 12. The conveying roller is driven by a rotating shaft 14A. The front of the of the paper tray has a recess 10D which allows the springboard 10A to jitter. The springboard 10A can tilt from an axis 10C from position 10A to position 10B when more paper P is stacked against the springboard 10A. The paper is positioned to provide contact CP between the paper P and the conveying roller 14. The friction between the roller 14 and the paper P causes the paper to be fed though the guide G to a next position. A friction plate 16 is pushed by a second spring 18 to make contact with the conveying roller. FIG. 1C shows the front end of the paper tray causing the springboard 10A to tilt to a position 10B when more paper lays over the spring board.

Conventional practice dictates that the paper be manually fed, so that the paper is properly positioned and not be misfed.

Another problem with conventional paper feeder is that more than one sheet of paper may be unintentionally fed at the same time due to pressure of the remaining stack of paper in the tray pushing the sheet of paper being fed. Such misfeeding may cause the successive sheets to stagger and the printout to be distorted.

SUMMARY

An object of this invention is to automatically feed paper to a printer. Another object is to avoid misfeeding of paper in a printer. Still another object of this invention is to avoid human error in feeding paper to a printer. A further object of the present invention is to prevent more than one sheet of paper being fed at the same time.

These objects are achieved in this invention by using a resilient friction pad to push against a conveying roller. The resilient friction pad is housed in a recess at the front end of a paper tray. Each sheet of paper from the paper tray is conveyed one by one between the resilient friction pad and the conveying roller automatically.

To prevent more than one sheet of paper being fed at the same time, two springs are used to reduce the pressure of the sheets remaining in the tray

DETAILED DESCRIPTION OF THE PREFERRED EMBODIMENT

Figure 2A:
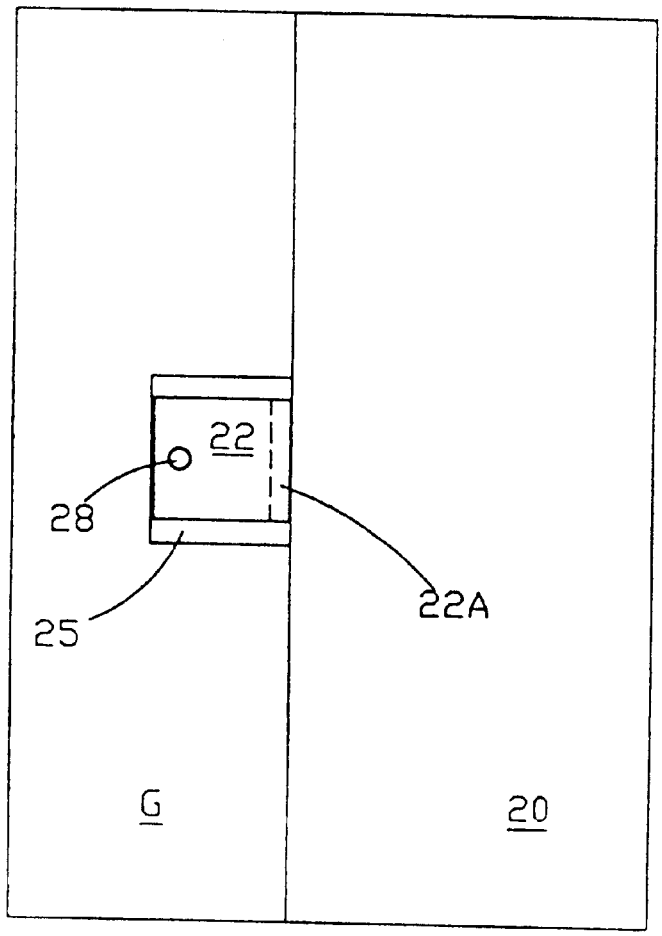
FIG. 2A shows the top view of the paper feeding mechanism of the present invention with a friction plate.
Figure 2B:
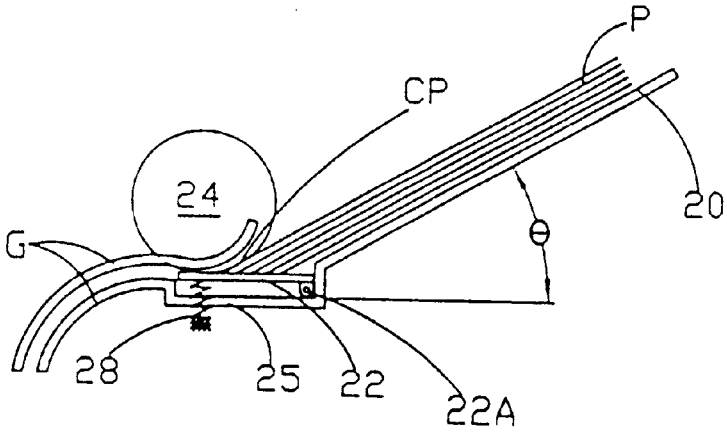
FIG. 2B shows the side view of FIG. 2A.

FIG. 2A shows the top view of the paper feeding system of the present invention. The paper tray 20 has a rectangular recess 25 placed at the front end. A resilient friction pad 22 is inserted in the recess 25. The resilient friction pad 22 has one end 22A pivoted at the wail of the recess 25 near the paper stack P. The other end of the resilient friction pad 22 is pressed upward by a spring 28 through a piece of paper fed from the paper tray against the conveying roller 24. The paper from the paper tray is then sequentially fed through a guide G to the next position. The friction pad 22 is made of resilient material. When a large number of sheets is stacked in the paper tray to be fed, the heavy weight of the stack of paper causes the resilient friction pad 22 to warp downward. The warping of the friction pad may separate the contact between the conveying roller 24 and the friction pad. Since the spring is placed below the resilient friction pad 22 to push the friction pad 22 upward, a good contact between the friction and the conveying roller can be maintained.

The paper tray 20 forms an angle of θ with horizon. The paper P in the paper tray can slide down along the paper tray for the paper to make contact with the conveying roller at point CP. Thus, the paper is automatically fed to the correct position.

Figure 2C:
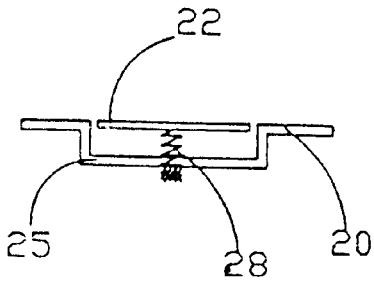
FIG. 2C shows the front view of the paper tray.

FIG. 2C shows the front end of the paper tray. The paper tray 20 has a rectangular recess 25. The compliant friction pad 22 is pushed by the spring 28 to contact the conveying roller 24.

Figure 2D:
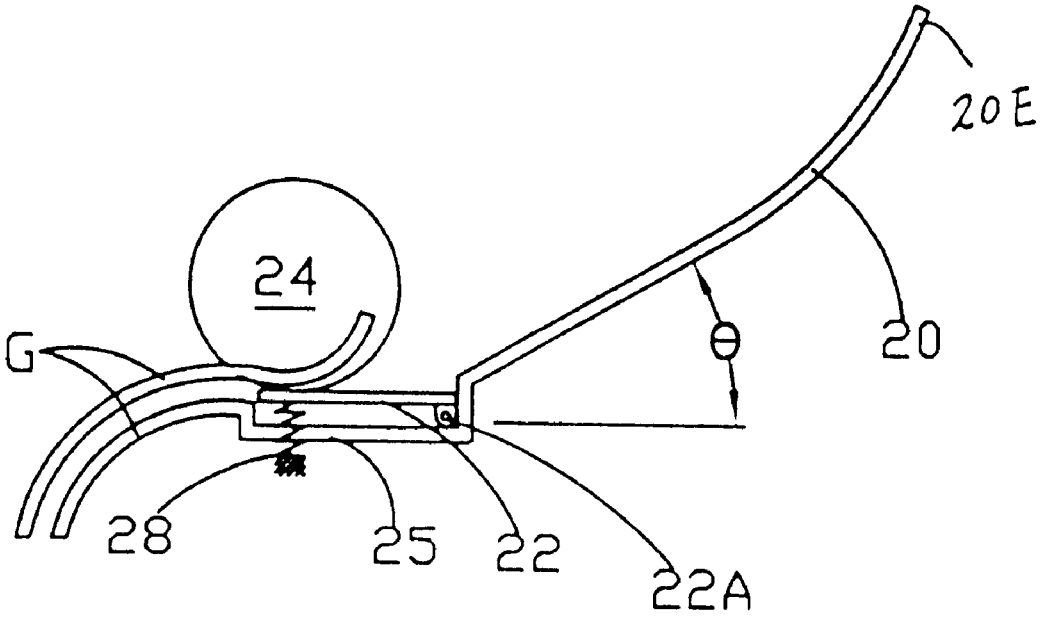
FIG. 2D shows an end view of the paper tray of a first design.

FIG. 2D shows a modified construction of the paper tray 20. The end of the paper tray 20 is tilted at the end the end 20E in an arc shape. With an arc shape paper tray, the paper can slide down more readily.

Figure 2E:
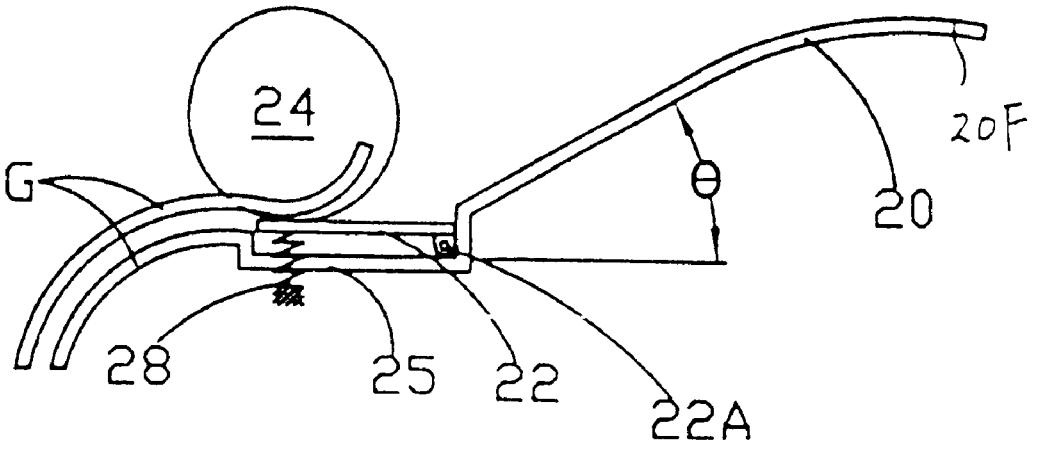
FIG. 2E shows the end view of the paper tray of a second design.

FIG. 2E shows another modification of the paper tray 20. The end 20F of the paper tray is tilted downward to reduce the downward sliding force.

Figure 3A:
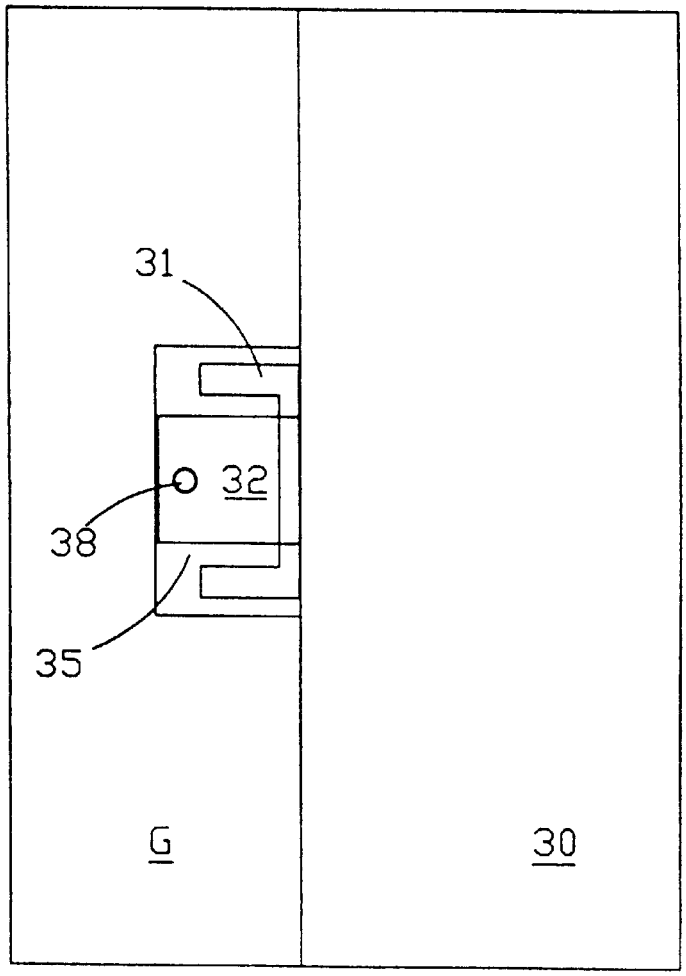
FIG. 3A shows the top view of a second embodiment of the present invention.

FIG. 3A shows a second embodiment of the present invention. The paper tray 30 further contains a U-shaped elastic plate 31 lying on top of the compliant friction pad 32, which is pivoted at point 32A. The front end of the friction pad is slightly less than the edge of the recess 35, so that the compliant friction pad can maintain contact with the conveying roller 34 and that the paper tray can feed to the contact sheet by sheet.

An auxiliary U-shaped spring 31 is inserted at the end of the friction pad to reinforce the uplifting capability of the friction pad 32 when heavy paper weight rests against the friction pad to separate the contact between the friction pad 32 and the conveying roller 34. In other words, the spring 31 increases the capability of the paper tray to hold more sheets of paper, thus increasing the operating speed when a large number of sheets are to be handled.

Figure 3B:
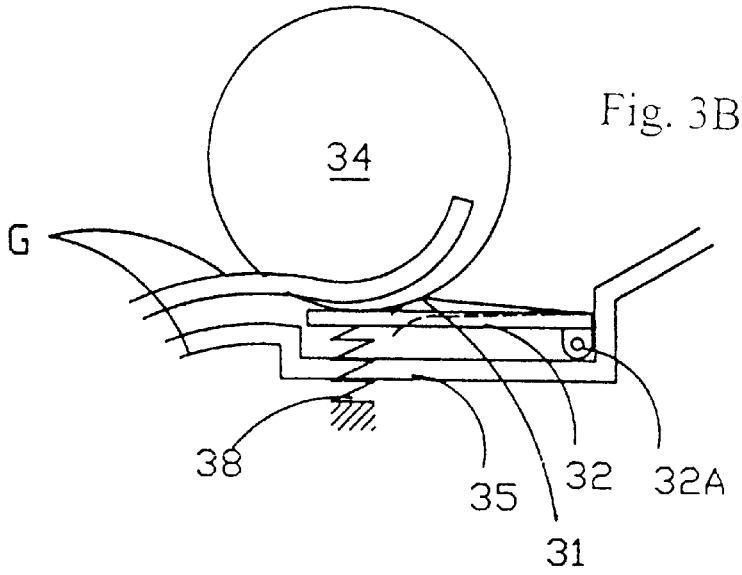
FIG. 3B shows the side view of FIG. 3A.

FIG. 3B shows the side view of FIG. 3A. It can be seen that the elastic spring 31 bends upward to reduce the weight exerted on the friction pad 32.

Figure 3C:
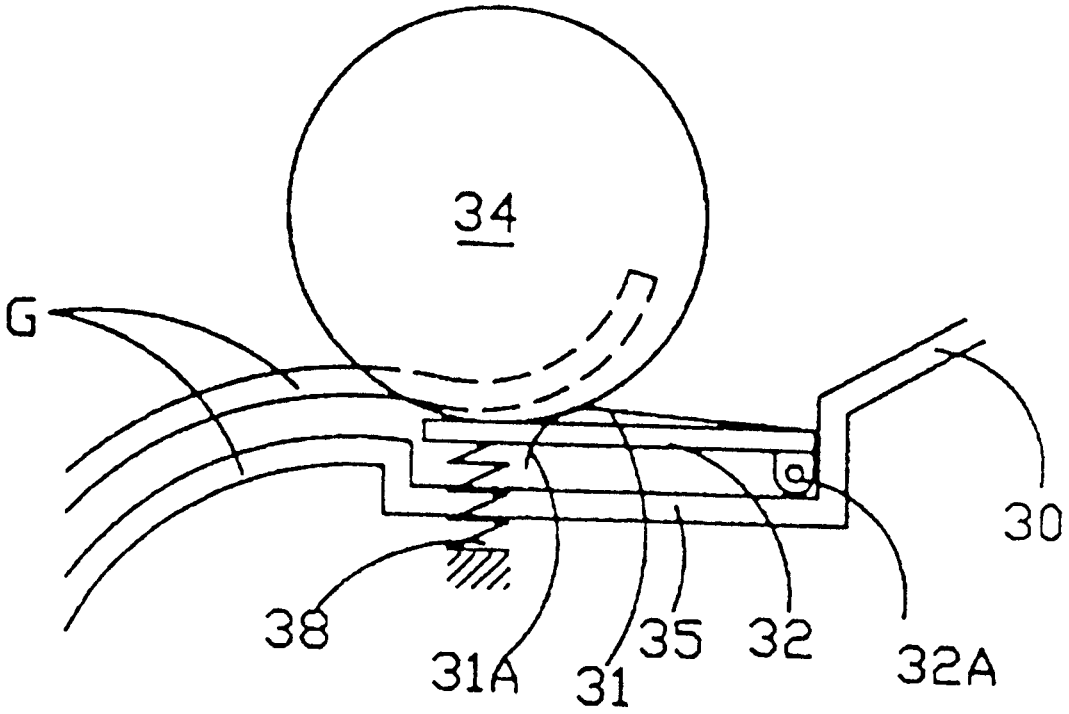
FIG. 3C shows the paper feeding mechanism with an auxiliary push-up spring.

FIG. 3C shows an elastic spring 31 design with a hooked end 31A. When the paper weight is too heavy, the end of the hook touches the bottom of the recess and prevents the friction pad 32 from being overly bent to separate the friction pad 32 from the conveying roller 34.

For a simpler design, the elastic spring plate 31 can be flat and placed either above or below the friction pad 32. Such a flat plate design cannot withstand as much paper weight as a hooked elastic plate.

Figure 4A:
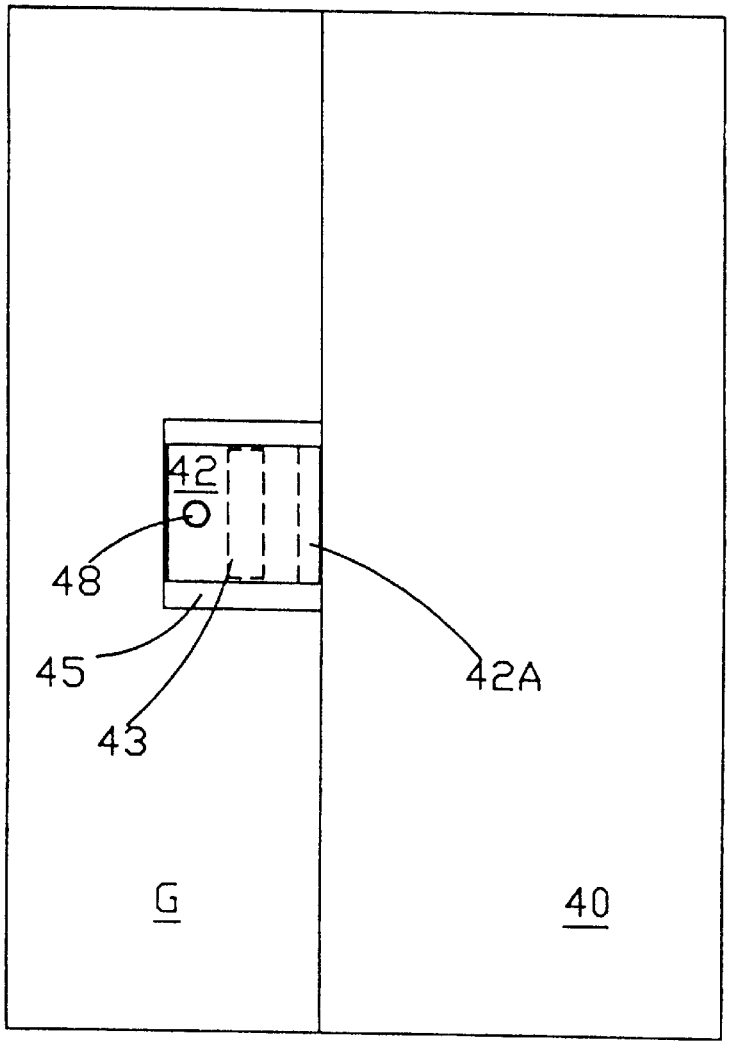
FIG. 4A shows the top view of a third embodiment of the present invention.

FIG. 4A shows a third embodiment of the present invention. The paper tray 40 has a recess 45 near the frontend center. A resilient friction pad 42 is inserted in the recess 45 and pivoted at one end at point 42A near the recess wall. The friction pad is pressed upward near the other end by a spring 48 against the conveying roller 44. Sheets of paper from the tray is sucked by the conveying roller sequentially for transmittal through the guide plate G to the next position.

This third embodiment further includes a support block 43 below the friction pad 42. When there are too many sheets in the tray, the heavy load may cause the friction pad 42 to sag and to separate from the conveying roller. The insertion of a support block 43 increases the capacity of the friction pad 42 to carry more paper.

Figure 4B:
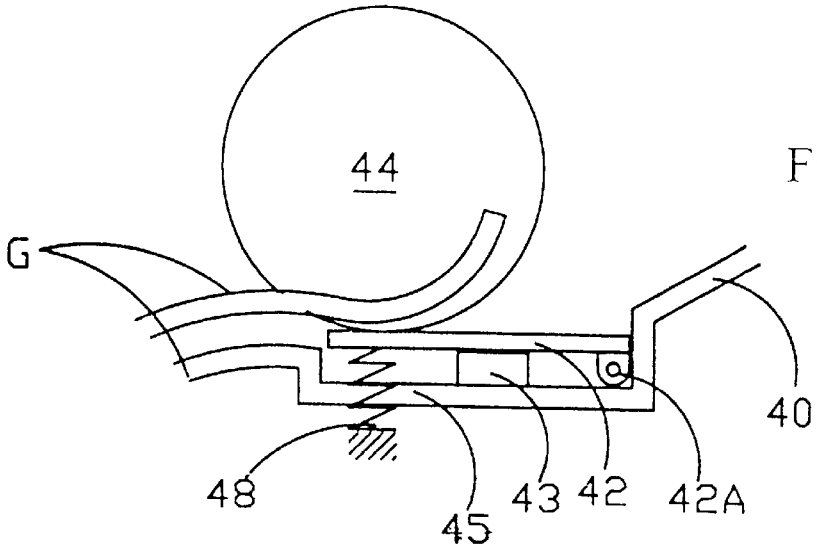
FIG. 4B shows the side view of FIG. 4A.

FIG. 4B shows the side view of the paper feeding mechanism shown in FIG. 4A showing the relative position of the support block 43 to the friction pad 42. The area of the support block 43 can be increased to increase the capability of the friction pad 42 to carry more paper weight.

Figure 5A:
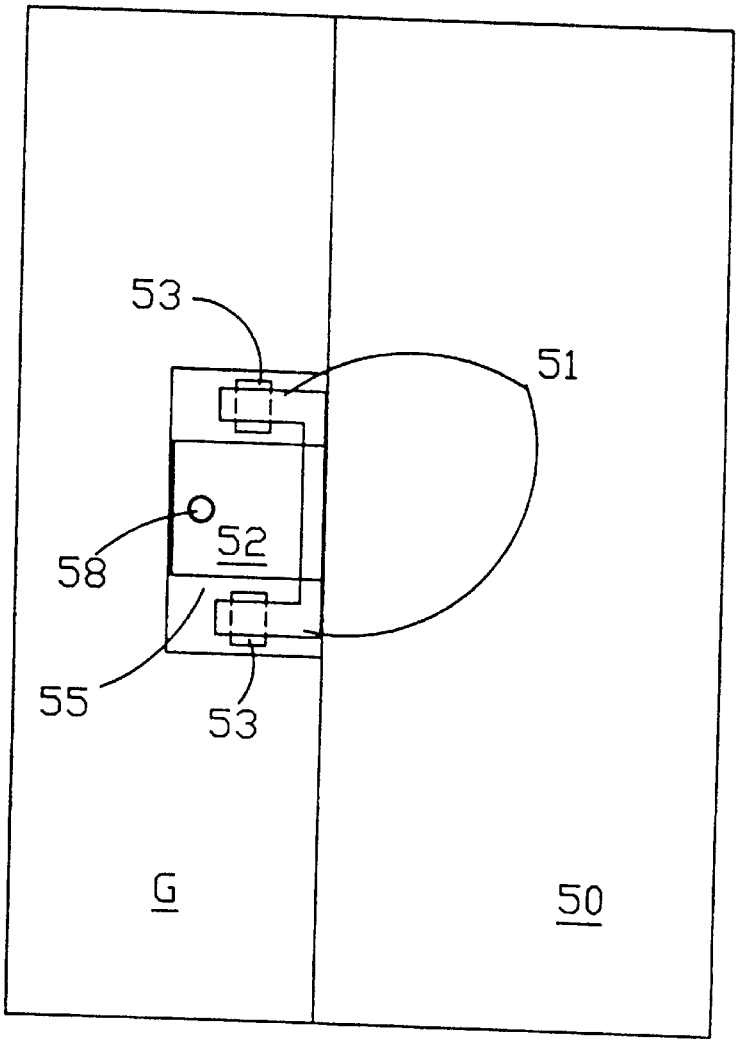
FIG. 5A shows the top view of a fourth embodiment of the present invention.

FIG. 5A shows a fourth embodiment of the present invention. The paper tray 50 has a rectangular recess 55 near the frontend center. A resilient friction pad 52 is inserted in the recess 55 and pivoted at a fixed point 52A along the wall of the recess 55. The free end of the friction pad is pressed upward by a spring 58 to make contact with a conveying roller 54, which sucks the paper from the paper tray one by one and conveys the paper to another position. FIG. 5A shows the top view of the paper feeding mechanism with a U-shaped auxiliary spring 51, which relieves the heavy weight of the paper stack on the friction pad. Two support blocks 53 are placed the under the two arms of the U-shaped auxiliary spring 51 and also shown in FIG. 5B for strengthening the auxiliary spring 51 when the paper weight is too heavy. With these support blocks, the friction pad 52 can be prevented from separating from the conveying roller 54. Therefore the double-arm auxiliary spring 31 can share the paper load with the resilient friction pad 52. When the paper weight is further increased, the support block 53 can prevent the excessive sagging of double arm auxiliary spring 51 and hence the separation of the friction pad 52 from the conveying roller 54.

The double arm auxiliary spring 51 can have other designs. For instance, a single arm spring may be inserted in the middle of recess to obtain a similar function. The ends of the auxiliary spring 51 can be bent downward as in FIG. 3C. The function of the bend is to limit the degree of bending of the auxiliary spring 51 when the bent end of the elastic spring touches the bottom of the recess 55.

Figure 5B:
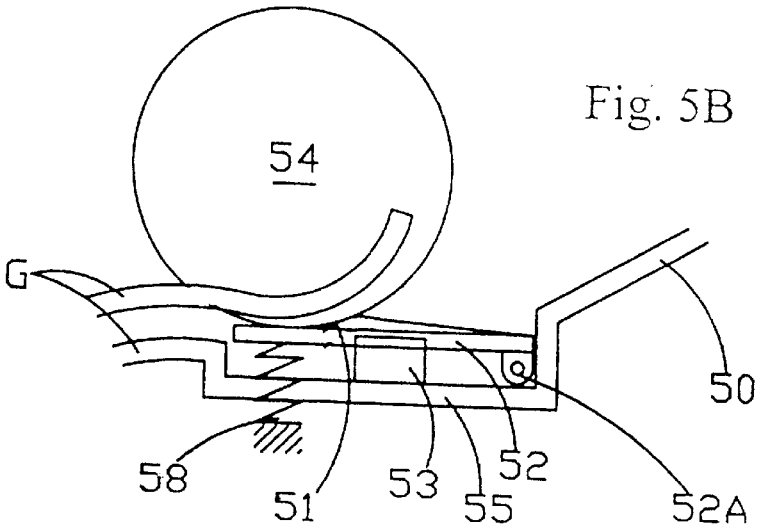
FIG. 5B shows the side view of FIG. 5A.

FIG. 5B shows the side view of FIG. 5A, where the double-arm auxiliary spring 51, the friction pad 52 and the support block 53 are placed.

Figure 6:
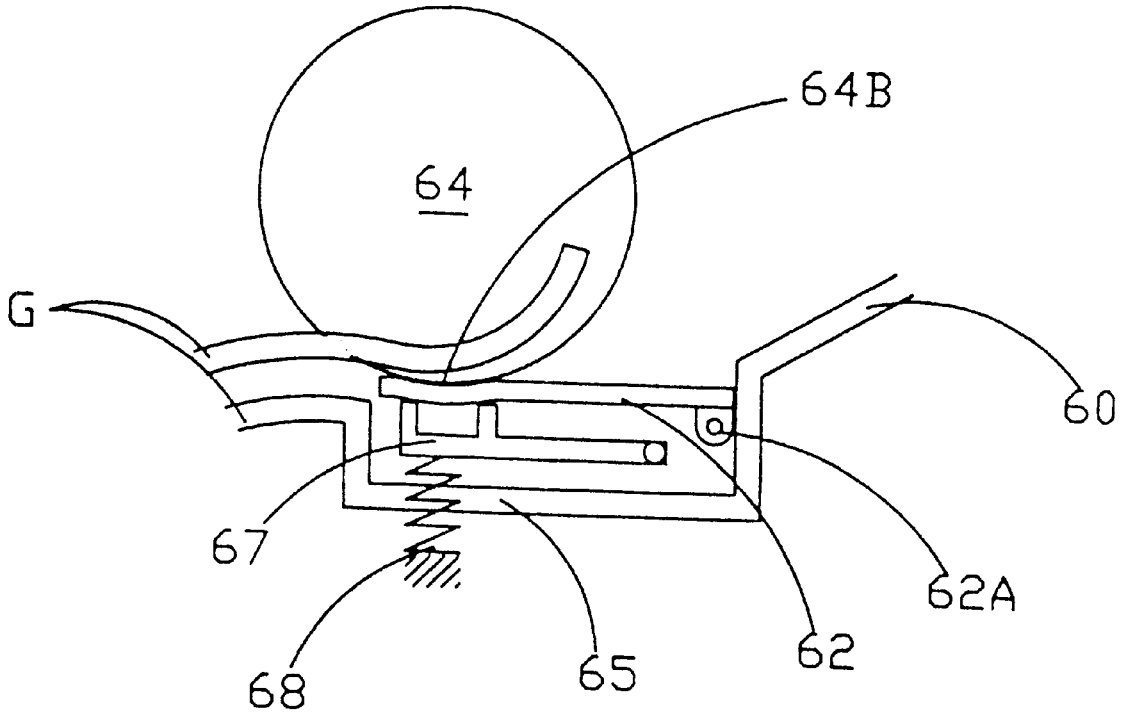
FIG. 6 shows a corrugated push-up arm for FIG. 5.

FIG. 6 shows a fifth embodiment of the present invention. A push up arm 67 is used to push up the resilient friction pad 62. The push up arm 67 has two protrusions, above which the friction pad 62 makes contact with the conveying roller 64 along the contact surface 64B. With these protrusions, the contact between the conveying roller 64 makes a more intimate contact 64B with the resilient friction pad 62.

Figure 7A:
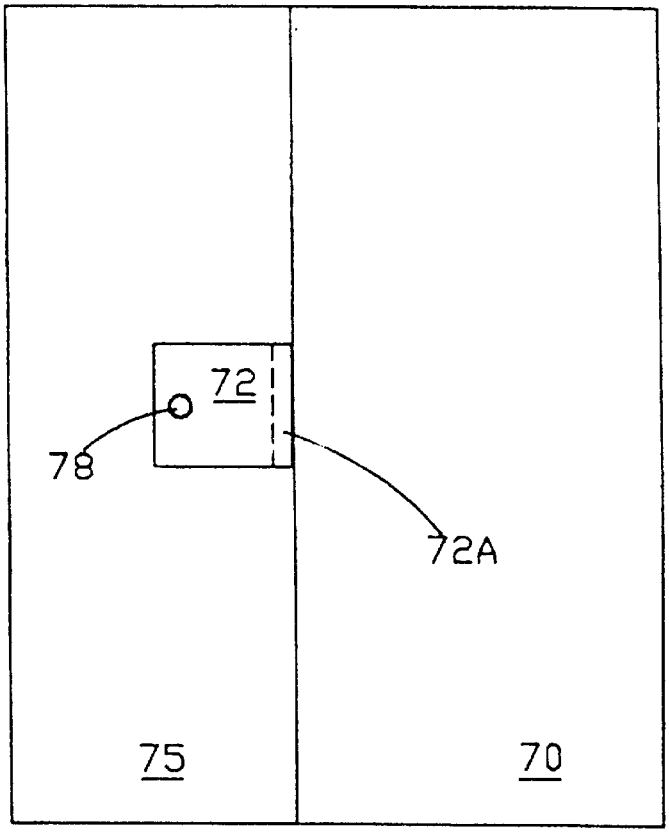
FIG. 7A shows a modified design using a friction pad.
Figure 7B:
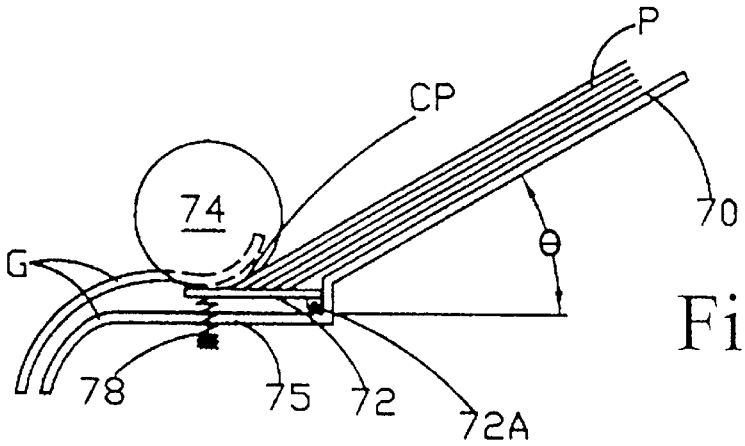
FIG. 7B shows the side view of FIG. 7A.
Figure 7C:
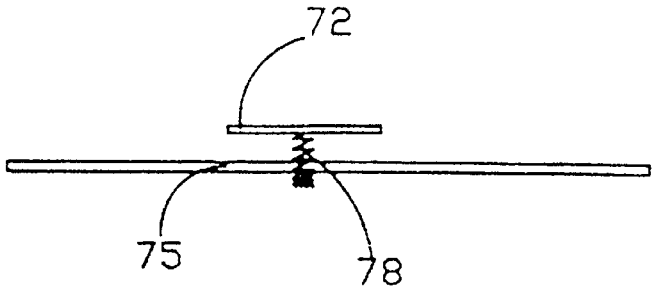
FIG. 7C shows the front view of the paper tray.

FIG. 7A shows a modified design of FIG. 2A. The feature of this design is that the bottom of the guide G is coplanar with the bottom of the recess 75. The resilient friction pad 72 is placed above the bottom of the recess 75 FIGS. 7A–7C shows that the front end of the paper tray has a lower guide plate 75 of the paper guide G. A resilient friction pad 72 is placed above the lower guide plate 75 and is pivoted at a point 72A at the side wall of the recess 75. The resilient friction pad 72 is pushed up at the front end by a spring 78, so that the friction pad and the conveying roller 74 are in elastic contact to covey the paper sheet by sheet from the tray to the another position through the guide G. When there is a large number of paper, the weight of the paper may press the friction pad downward to affect the contact between the conveying roller 74 and friction pad 72. A push-up spring 78 is placed below the friction pad to insure good contact between and conveying roller 74 and the friction pad 72. The paper tray 70 is tilted by an angle θ, so that the paper in the stack P can slide down by gravity to be contacted by the conveying roller at point CP. Thus the paper is automatically fed from the paper tray.

Figure 1A:
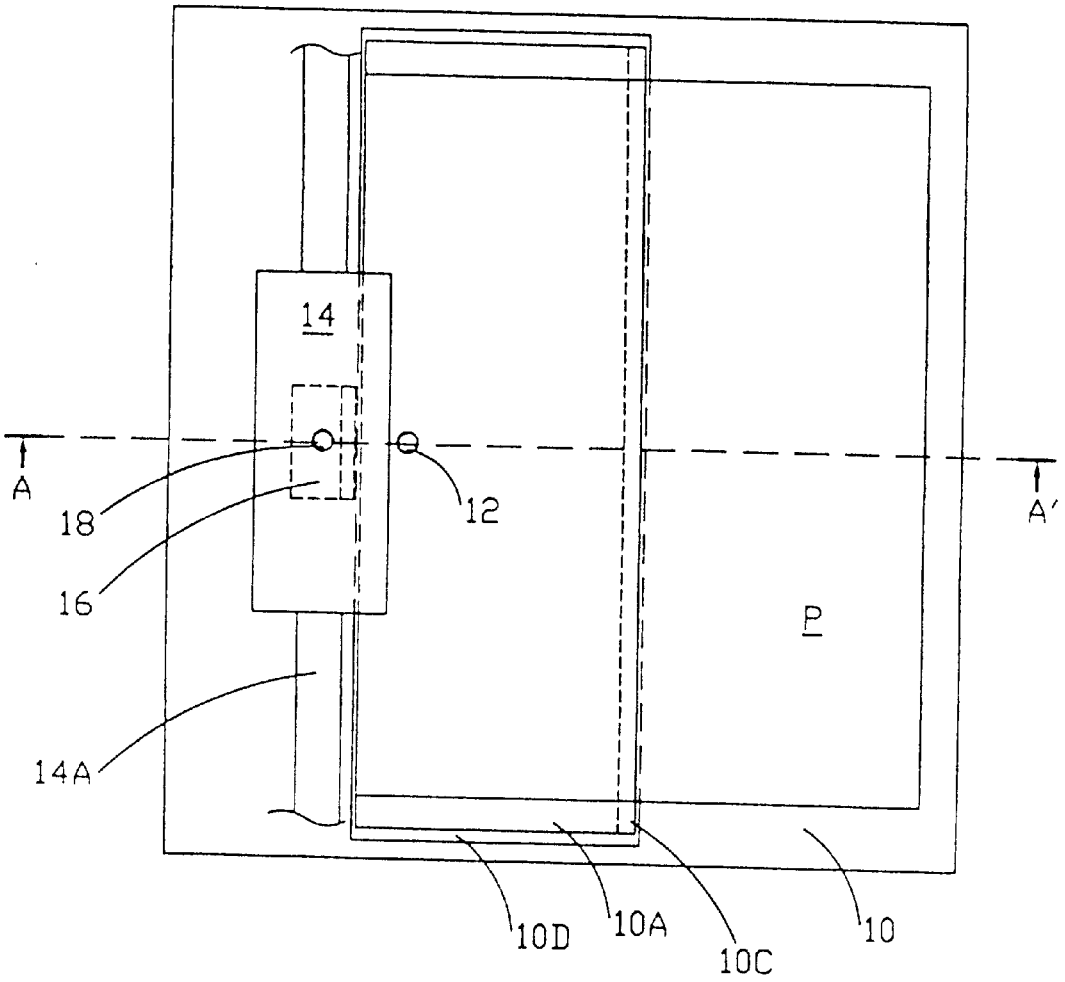
Fig. 1A Prior Art
FIG. 1A shows the top view of the paper feeding mechanism of a traditional printer.
Figure 1B:
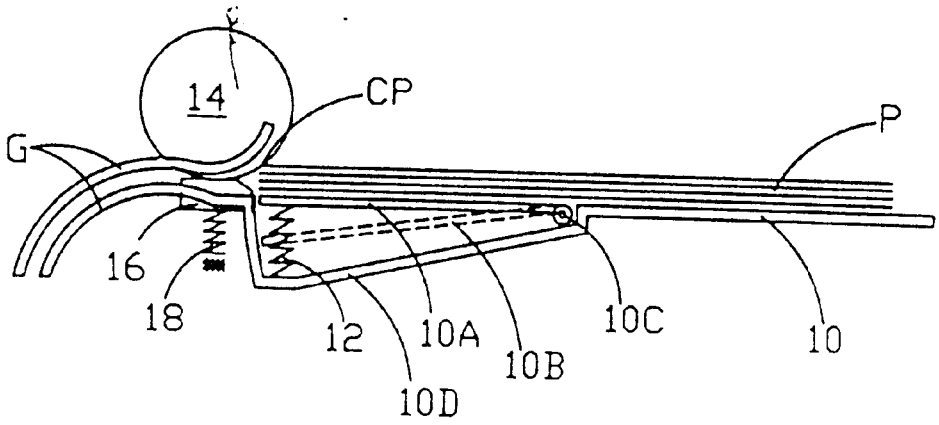
Fig. 1B Prior Art
FIG. 1B shows the side view of FIG. 1A.
Figure 1C:
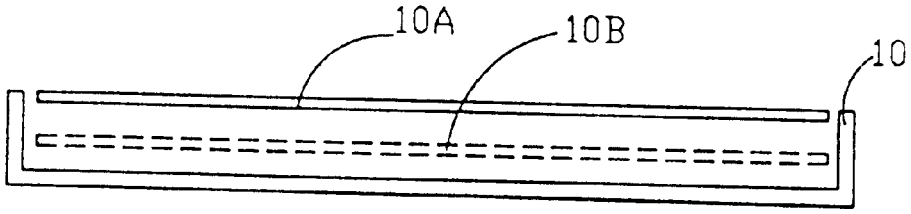
Fig. 1C Prior Art
FIG. 1C shows the front view of the paper tray.

FIG. 7B shows the side view of FIG. 7A. FIG. 7C shows the front view of the paper tray 70. The resilient friction pad is placed above the lower guide plate 75 by a spring 78. In a conventional design shown in FIG. 1C the paper tray has a wide hard (non-resilient) spring board which can be tilted to positions such as 10A or 10B. In this invention, the resilient friction pad 72 is a narrow resilient plate, which can be pushed by a spring 78 to make contact with the conveying roller.

Figure 7D:
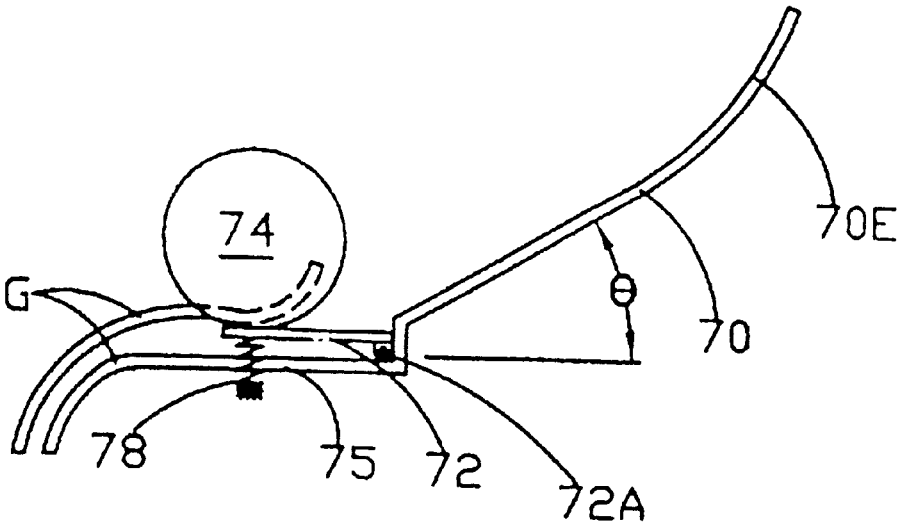
FIG. 7D shows one design of the end view of the paper tray.
Figure 7E:
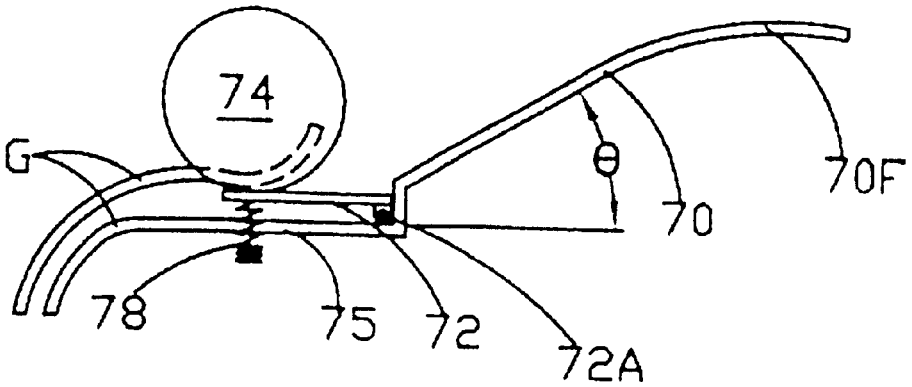
FIG. 7E shows a second design of the end view of the paper tray.

FIG. 7D shows a modified design of the tail end 70E of the paper tray 70. The upward tilted end 70E causes the paper slide down more vigorously. FIG. 7D shows another design of the tail end 70F of the paper tray 70. The downward tilted end 70F causes the paper to slide down less vigorously.

Figure 8A:
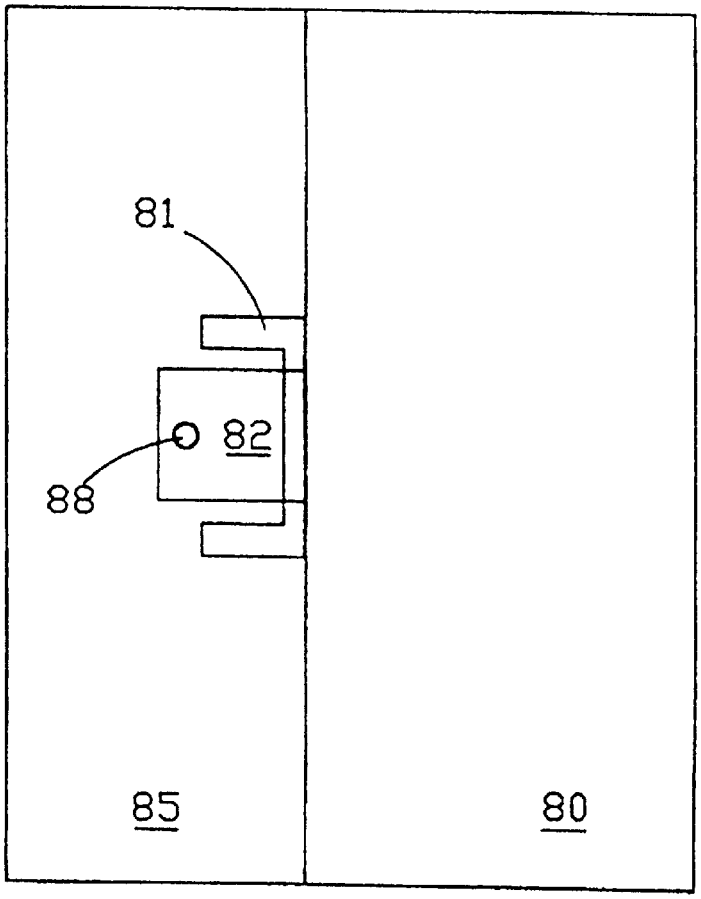
FIG. 8A shows a modified design of FIG. 3A.

FIG. 8A shows a modified design of the paper feeding mechanism shown in FIG. 3A. The modified design shown in FIG. 8A and 8B has a lower plate of the paper guide G coplanar with the frontend recess 82 of paper tray 80. The resilient friction pad 82 is pivoted at point 82A of the inner recess wall of the paper tray and is pushed up at the free end by a spring 88 to contact the conveying roller 84, so that the roller 84 can feed paper one by one automatically. The structure further contain a U-shaped auxiliary spring 81, which exerts an up-lifting force to the conveying roller 84 and share the load with the resilient pad 82 when heavy paper load is placed on the friction pad 82. Otherwise the heavy paper load may cause the friction pad 82 to disengage with the conveying roller. If the double-arm auxiliary spring 81 is not used, the paper tray may not be able to handle as many pieces of paper. The double-arm fiat spring 81 may be replaced with a single arm spring and placed either above or below the friction pad 82. The double arm flat spring 81 may also be bent downward at the end similar to FIG. 3B.

Figure 8B:
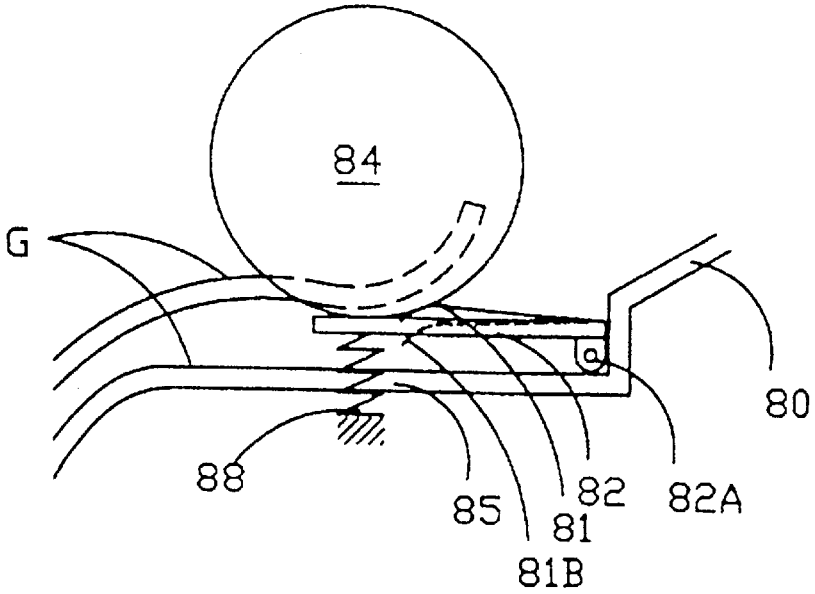
FIG. 8B shows a side view of FIG. 8A.

FIG. 8B is the side view of FIG. 8A, showing an auxiliary spring 81 with the end 81B bent. Under heavy paper pressure, the end of the spring 81 may be bent to a position 81B.

Figure 8C:
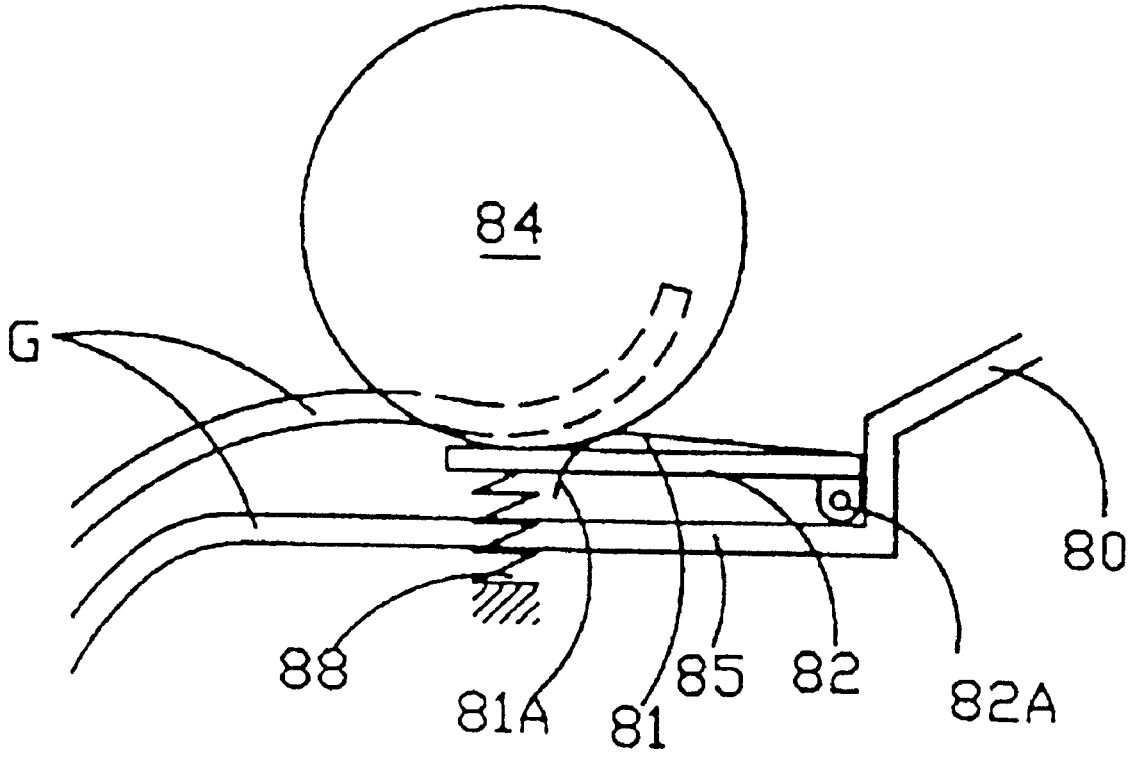
FIG. 8C shows FIG. 8A with a bent auxiliary push-up spring.

FIG. 8C is similar to FIG. 8B except that the end 81A of the spring 81 is bent more than the end 81B in FIG. 8B. Under heavy pressure, the end 81A can touch the bottom of the guide plate 85. Then the auxiliary spring 81 can bend no longer. The friction pad 82 is prevented from having excessive bending to separate from the conveying roller 84.

Figure 9A:
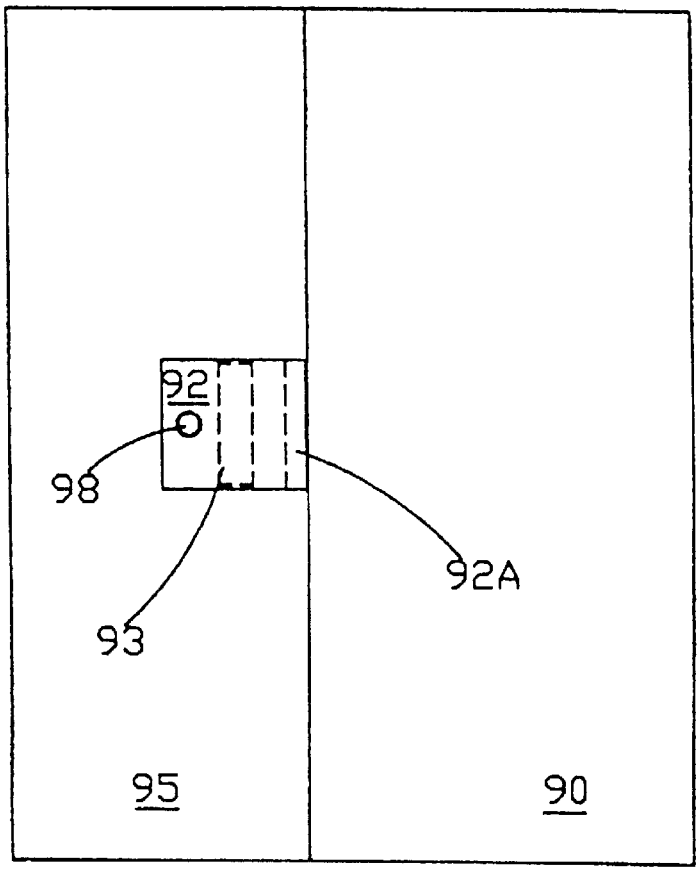
FIG. 9A shows a modified design of FIG. 4A.

FIG. 9A shows a modification of the structure shown in FIG. 4A. The difference is that the bottom of the front end recess of the paper tray is made coplanar with the bottom plate of the paper guide G. A resilient friction pad 92 is pivoted at 92A near the recess wall of the paper tray 90. A spring 98 pushes the other end of the friction pad upward to contact the conveying roller 94. A support block 93 is inserted below the middle of the friction pad 92. This support block 93 prevents sagging of the friction pad 92. With this support block 93 pushing the friction pad 92, the end of the friction pad 92 also makes more positive contact with the conveying roller 94. Conversely, if the support block 93 is not used, the paper tray 90 cannot stack as many pieces of paper.

Figure 9B:
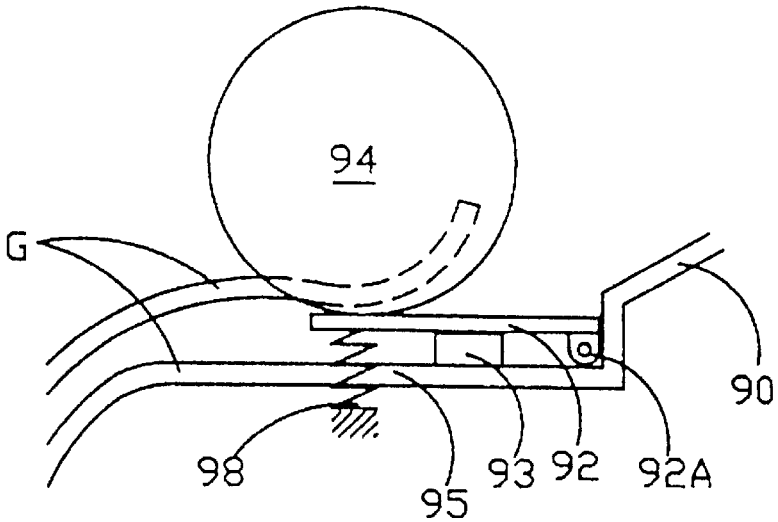
FIG. 9B shows the side view of FIG. 9A.

FIG. 9B shows the side view of FIG. 9A.

Figure 10A:
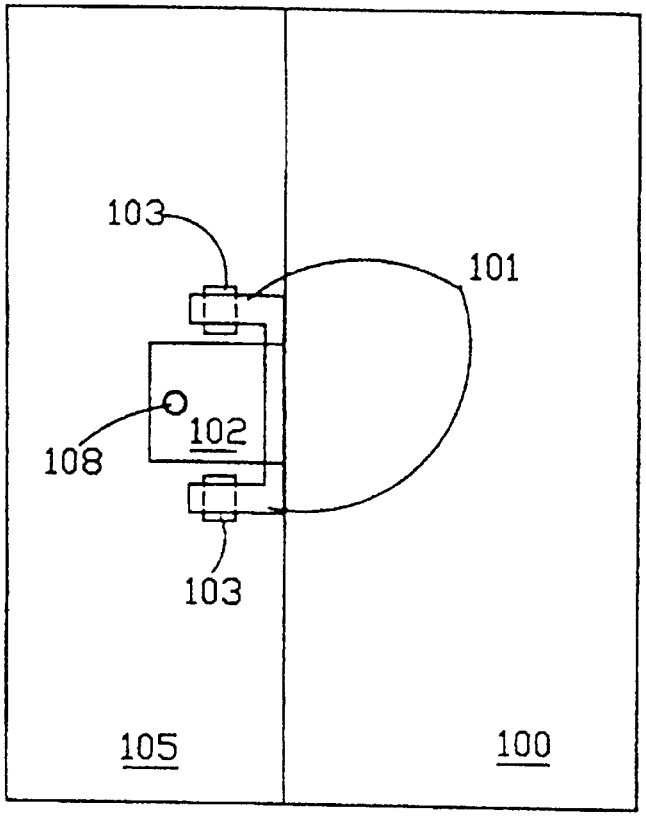
FIG. 10A shows a modified design of FIG. 5A.
Figure 10B:
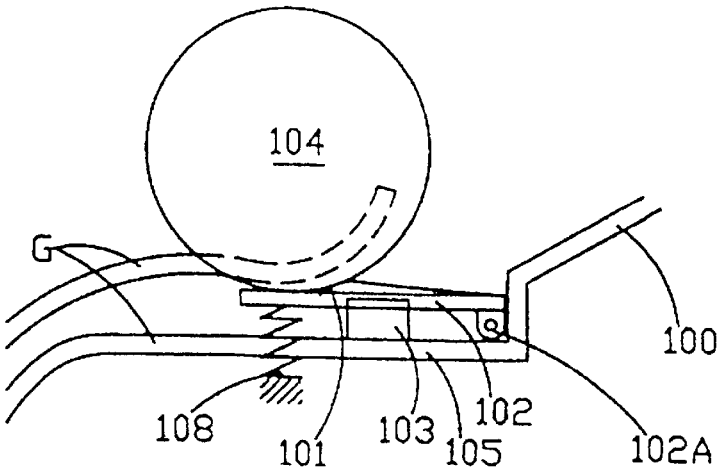
FIG. 10B shows the side view of FIG. 10B.

FIG. 10A shows the top view of a modified design of FIG. 5A. The major difference is that the bottom of the recess 105 for the paper tray 100 is made coplanar with the side of the paper guide G. The resilient friction pad 102 is pivoted to the wall of the recess 105 at point 102A and supported by a spring 108 at the free end to push against a conveying roller 104, so that the conveying roller can feed the paper from the paper tray 100 automatically. A U-shaped flat auxiliary spring 101 is placed around the friction pad 102 to share the heavy paper load. A support block 103 is inserted below each arm of the flat auxiliary spring 101 to prevent sagging of the arms and excessive bending of the resilient friction pad 102. The flat auxiliary spring 101 can be modified as a single arm flat spring placed above or below the friction pad 102. The arms of the flat auxiliary spring 101 can have a straight end or a curved end. The curve end can stop the excessive of bending of the flat auxiliary spring 101 when the end is stopped at the lower guide plane 105. FIG. 10B shows the side view of FIG. 10A.

Figure 11:
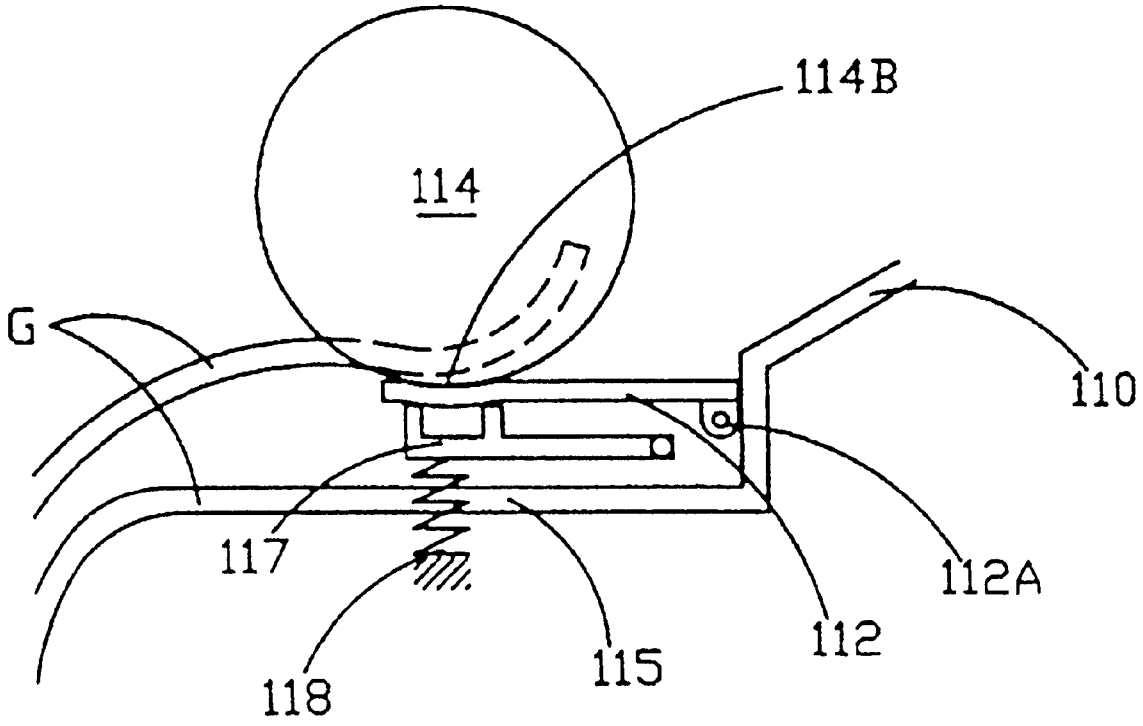
FIG. 11 shows a modified design of FIG. 6.

FIG. 11 shows the side view of a modified design of FIG. 6A. The structure has a recess 115 of the end of the paper tray 11 coplanar with the lower side of the paper guide G. A resilient friction pad 112 is pivoted at the side wall of the recess 115 at one end at point 112A. The free end of the friction pad 112 is supported by a spring 118 through a corrugated arm 117 to push against a conveying roller 114. The contact point 114B between the conveying roller 114 and the friction pad 112 lies midway between two protrusions of the corrugated arm 117. With the support of this corrugated arm, the friction pad 112 can make a more intimate contact with the conveying roller 114 and insure more positive feeding of the paper.

Figure 12:
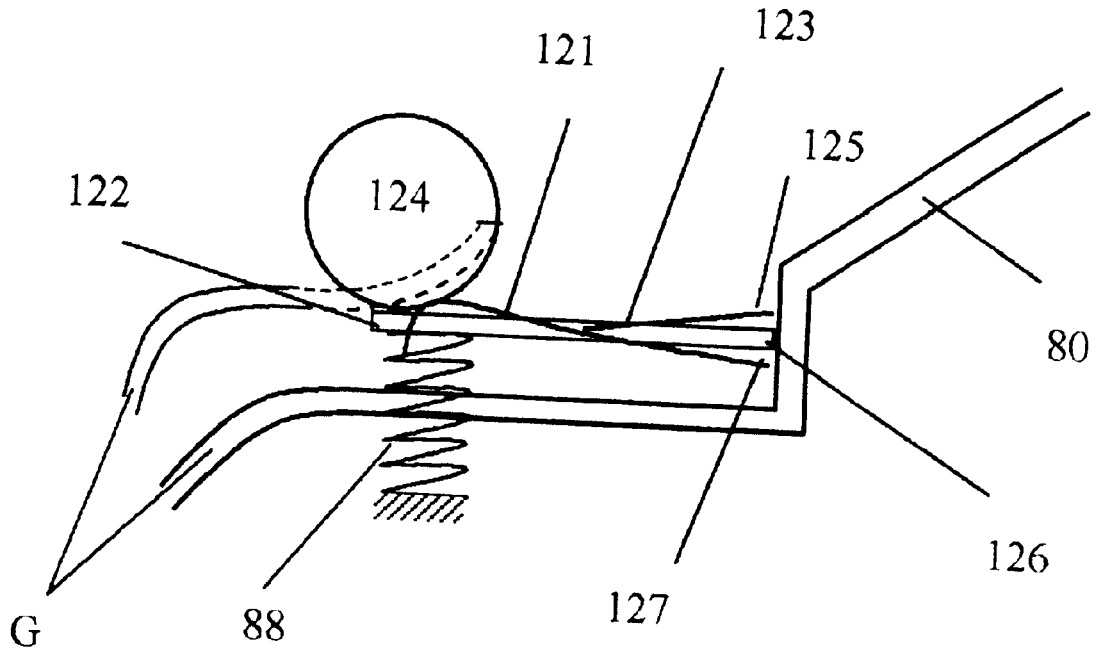
FIG. 12 shows another design of the paper tray with two push-up springs
Figure 13:
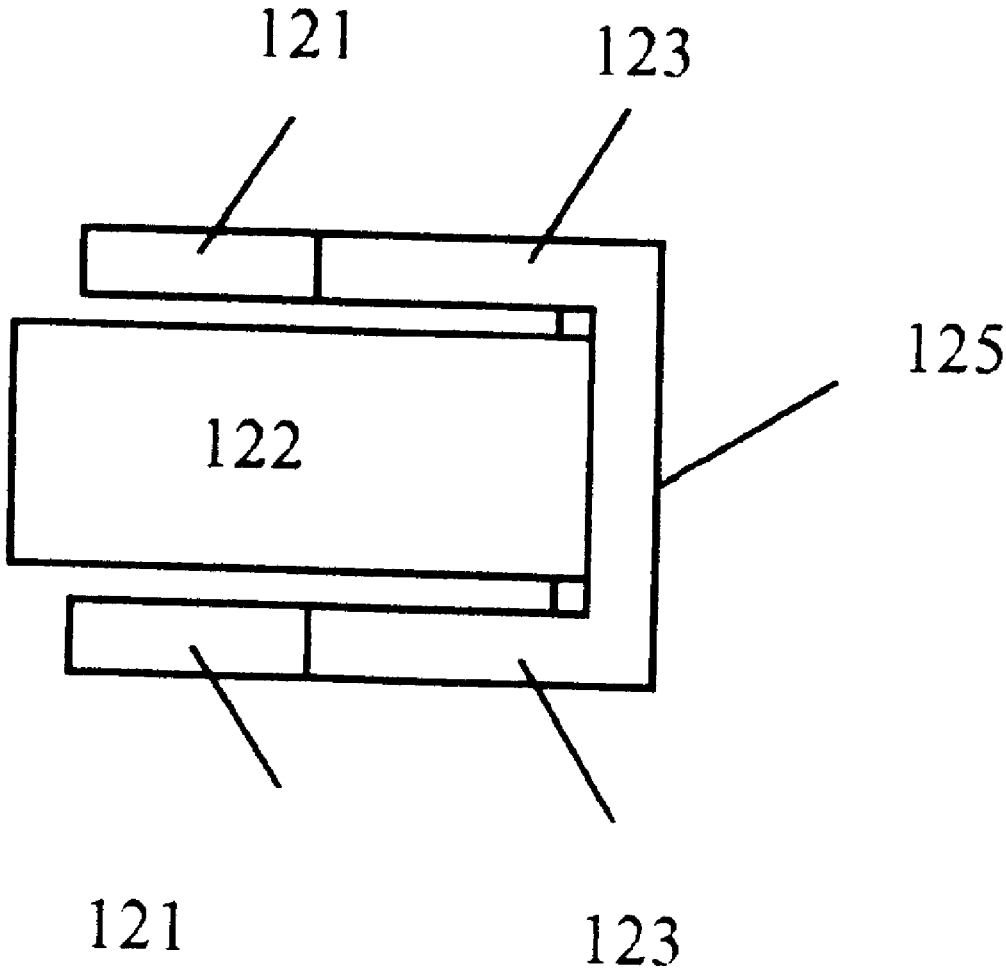
FIG. 13 shows a top view of FIG. 12.

FIG. 12 is another embodiment of the paper tray. The structure is similar to FIG. 3*a*. that two 2-arm uplifting springboards 121 and 123 are used and placed between the resilient friction pad 122. The front end of the resilient friction pad 122 engages the conveying roller 124. When the roller rotates, the friction force of the roller sucks the paper P and conveys it to another position. The springboard 121 and springboard 123 both have U-shaped double arms as shown in FIG. 13 and straddle over the resilient friction pad 122. The springboard 121 tilts upward toward the roller 124. The springboard 123 tilts upward in the opposite direction. The end of the friction 122 is sandwiched between the two closed ends 125 and 127 of the two U-shaped springboards 123 and 121, respectively. The function of the two springboards is to give more uplifts to the friction pad 122, so that can handle more paper. Due to the uplifting of the smooth surface of the spring board 123, the paper can continue to slide toward the roller 124 when only few sheets of paper are fed.

FIG. 13 shows the top view of the mechanism. The two arms of the U-shaped springboards 121 and 123 clear the friction pad 122 at two sides. When there are only a few sheets of paper, the sheets are lifted higher by the springboard 123 and slide toward the roller 124 readily. When the sheets of paper are numerous, the spring board 123 is depressed. One of the sheets of paper in the middle section of the stack of paper is aligned with the friction pad 122 and slides toward the friction pad 122 to be sucked by the roller 124. Since the sheet being fed is in the middle of the stack, there are not so many sheets on top to push the paper being fed. When the sheet is not pushed by a heavy weight, it is not likely that more than one sheet of paper are fed at the same time.

Figure 14:
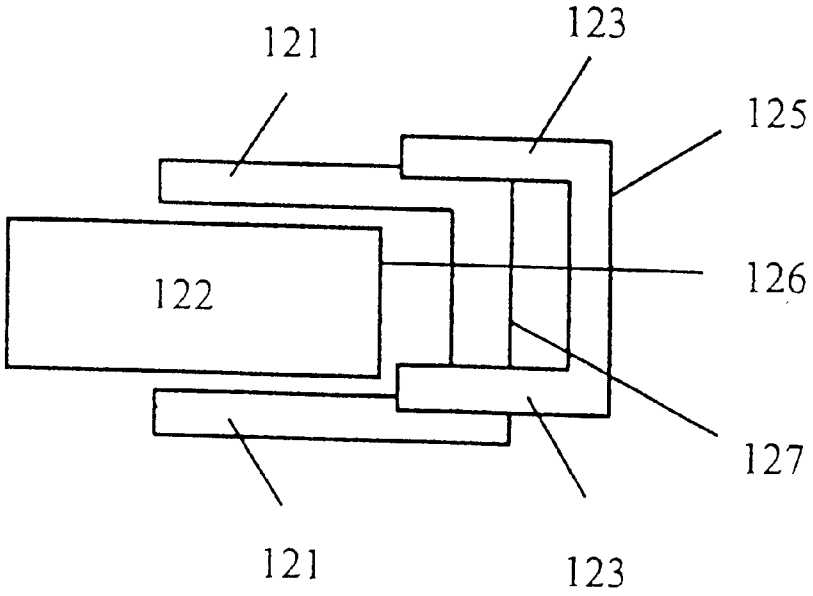
FIG. 14 shows the component parts of FIGS. 12 and 13.

FIG. 14 shows the component parts of the mechanism shown in FIGS. 12 and 13. It shows the uplifting springs 121 and 123. The springs can be of U-shape or independent parallel strips.

Figure 15:
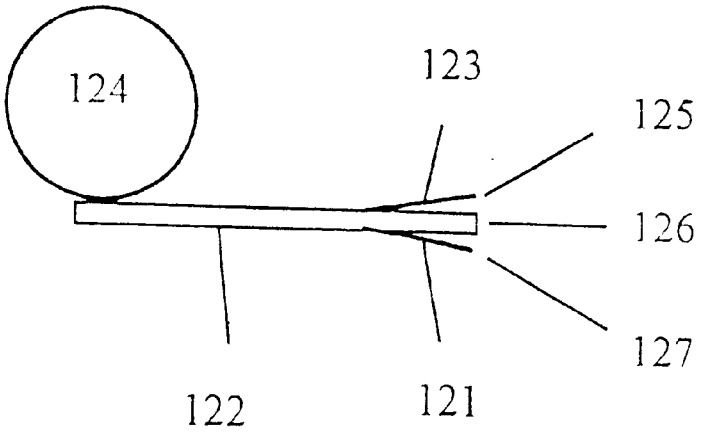
FIG. 15 shows another embodiment of the double push-up springs.

FIG. 15 shows another mechanism of the tail end uplift of the sheet for light stack of paper in the tray and tail end depression of the sheets in the tray when the stack is thick. Two springs 129 and 123 are placed at the tail end of the friction pad 122 with the tail end of the friction pad 126 sandwiched between the tail end 127 of the spring 129 and the tail end 125 of the spring 123. The spring 129 bends downward, and the spring 123 bends upward.

Figure 16:
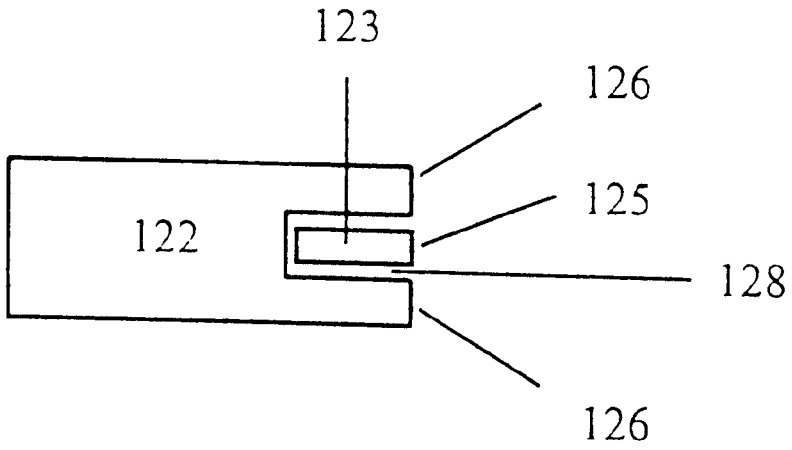
FIG. 16 shows the top view of FIG. 15.

The two springs 129 and 123 are placed inside a recess 128 of the friction pad 122 as shown in FIG. 16, which is the top view of FIG. 15. When the load of paper in the tray is light, the spring 121 lifts the paper tray upward to expedite the feeding of paper toward the front end of the friction pad 122. When the load of the paper in the tray is heavy, both springs 121 and 123 are depressed downward. Then the sheet of paper in the midsection of the paper stack in the tray is aligned with the surface of the friction pad 122 and sucked through the friction pad. The feeding of the sheet in the midsection of the paper stack reduces the pressure of the remaining sheets in the tray, thereby preventing more than one sheet being fed to the friction.

Figure 17:
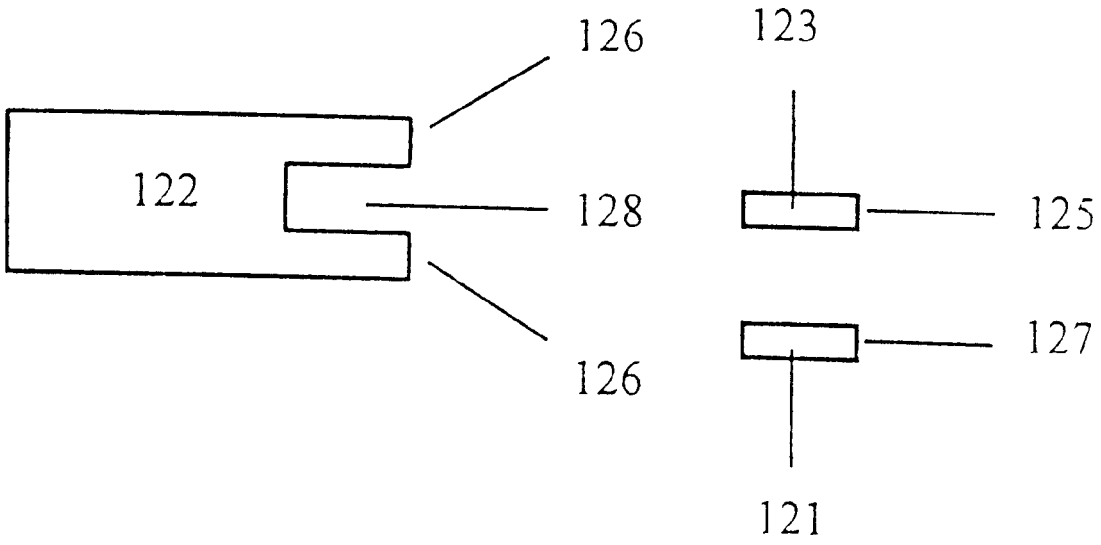
FIG. 17 shows the component parts of the FIGS. 15 and 16.

FIG. 17 shows the component parts of the paper feeding mechanism. The friction pad 122 has a recess 128 and two ends 126. The two springs 129 and 123 are inserted in the recess 128 of the friction pad 122 with the respective ends 127 and 125 aligned with the ends 126 of the friction pad 122.

While particular embodiments of the invention have been described, it will be apparent to those skilled in the art that various modifications may made without departing from the spirit of the present invention. Such modifications are all within the scope of this invention.

What is claimed is:

1. A paper feeding mechanism, comprising:

a paper tray with a slanted rear end;

a recess at the front end of said paper tray;

a roller for conveying paper from said paper tray;

a resilient friction pad pivoted at first end to a wall of said recess, and pushed up by a spring at a second end of said resilient friction pad against said roller so that paper from said paper tray is fed between said roller and said resilient friction pad automatically;

a first spring placed at the tail end of said resilient friction pad and bent upward to lift the paper being fed from the paper tray; and a second spring placed at the tail end of said resilient friction pad and bent downward when the load in the paper tray is heavy such that a paper in the upper section of said paper tray is fed, the tail end of said resilient friction pad being sandwiched between the tail end of said first spring and the tail end of said second spring.

2. A paper feeding mechanism as described in claim 1, wherein said first spring and said second spring are U-shaped each with two arms bordering said resilient friction pad.

3. A paper feeding mechanism as described in claim 2, wherein said first spring has a front end tilted upward to lift said roller.

4. A paper feeding mechanism as described in claim 1, wherein said first spring comprises two parallel strips.

5. A paper feeding mechanism as described in claim 1, wherein said second spring comprises two parallel strips.

6. A paper feeding mechanism as described in claim 1, wherein said resilient friction pad has recess at the tail end facing the paper tray, and said second spring are anchored inside said recess.

* * * * *